US011435160B2

(12) United States Patent
Scott

(10) Patent No.: US 11,435,160 B2
(45) Date of Patent: Sep. 6, 2022

(54) INSERT FOR A COLLAPSIBLE FIREARM RECEPTACLE OF A CONCEALED CARRY HOLSTER

(71) Applicant: Brave Response Shooting, LLC, Highland, UT (US)

(72) Inventor: Brandon R. Scott, American Fork, UT (US)

(73) Assignee: Brave Response Shooting, LLC, Highland, UT (US)

( * ) Notice: Subject to any disclaimer, the term of this patent is extended or adjusted under 35 U.S.C. 154(b) by 0 days.

(21) Appl. No.: 17/177,191

(22) Filed: Feb. 16, 2021

(65) Prior Publication Data

US 2021/0278172 A1 Sep. 9, 2021

Related U.S. Application Data

(60) Provisional application No. 62/976,624, filed on Feb. 14, 2020.

(51) Int. Cl.
*F41C 33/04* (2006.01)

(52) U.S. Cl.
CPC ..... *F41C 33/048* (2013.01)

(58) Field of Classification Search
CPC ..... F41C 33/02909; F41C 33/048; F41C 33/041; F41C 33/0272; Y10S 224/911; A45F 2200/0591; A45F 5/021
See application file for complete search history.

(56) References Cited

U.S. PATENT DOCUMENTS

| | | | | |
|---|---|---|---|---|
| 944,355 | A * | 12/1909 | Beasley | |
| 1,547,800 | A * | 7/1925 | Franz | F41C 33/0209 224/243 |
| 4,664,348 | A * | 5/1987 | Corsaut, III | B65B 67/1238 141/108 |
| 2015/0115005 | A1* | 4/2015 | Slinkard | F41C 33/0227 224/243 |
| 2019/0316875 | A1* | 10/2019 | Schmadeka | A45F 5/02 |

* cited by examiner

*Primary Examiner* — Corey N Skurdal
(74) *Attorney, Agent, or Firm* — Dentons Durham Jones Pinegar

(57) ABSTRACT

An insert for a collapsible firearm receptacle of a concealed carry holster includes a body that may fit snugly into the collapsible firearm receptacle. The insert may also hold the collapsible firearm receptacle in a somewhat open arrangement to facilitate the ready insertion of a barrel of a firearm into the collapsible firearm receptacle and removal of the barrel of the firearm from the collapsible firearm receptacle. The insert may include an outer wall, a front wall, and a rear wall that define an interior of the insert. The insert may also include a lip that protrudes outwardly to extend beyond an upper edge of the collapsible firearm receptacle. Concealed carry holsters that include the insert are also disclosed, as are methods of using the insert and concealed carry holsters that include the insert.

19 Claims, 5 Drawing Sheets

INSERT FOR A COLLAPSIBLE FIREARM RECEPTACLE OF A CONCEALED CARRY HOLSTER

CROSS-REFERENCE TO RELATED APPLICATION

A claim for priority to the Feb. 14, 2020 filing date of U.S. Provisional Patent Application 62/976,624, titled INSERT FOR A COLLAPSIBLE FIREARM RECEPTACLE OF A CONCEALED CARRY HOLSTER ("the '624 Provisional Application"), is hereby made pursuant to 35 U.S.C. § 119(e). The entire disclosure of the '624 Provisional Application is hereby incorporated herein.

TECHNICAL FIELD

This disclosure relates generally to concealed carry holsters for small firearms, such as handguns and, more specifically, to concealed carry holsters with collapsible firearm receptacles. Even more specifically, this disclosure relates to inserts that can hold the collapsible firearm receptacles of concealed carry holsters in at least partially open arrangements even when the collapsible firearm receptacle does not carry a firearm.

RELATED ART

Concealed carry holsters are typically designed to enable a wearer to secure a handgun to his or her body in a manner that enables the wearer to readily access the handgun while hiding the handgun, or concealing it from view. Concealed carry holsters are often made to arrange a handgun and any associated hardware (e.g., magazines, cartridges, etc.) on the wearer's body with a minimal profile to reduce the potential visibility of the handgun and any associated hardware beneath the wearer's clothes, or the "printing" of these items onto the wearer's clothes.

A variety of concealed carry holsters are configured to be worn around an individual's waist, beneath the waistband of his or her pants, shorts, skirt, or other lower body covering, or "bottoms." This type of concealed carry holster has also been referred to as a "concealed carry waist holster" or as a "CCW holster." Such a concealed carry holster typically includes a waistband that is made to extend completely around the wearer's waist and to securely fasten a holster body in place adjacent to the wearer's lower abdomen and or hip. The waistband of such a concealed carry holster is typically designed for comfort. The holster body of such a concealed carry holster, including the handgun receptacle and any pockets of the holster body, is often designed to receive a handgun and, optionally, additional cartridges, magazines, or other hardware in a manner that minimizes protrusion of the body of the concealed carry holster, the handgun carried by the handgun receptacle of the concealed carry holster, and any other hardware carried by the concealed carry holster and, thus, printing of these items onto the wearer's clothes.

Some concealed carry holsters are made from materials that enable their firearm receptacles to hold their shapes regardless of whether they hold a firearm. The materials that are used to form such concealed carry holsters (e.g., leather, the thermoplastic acrylic-polyvinyl chloride materials manufactured by Sekisui SPI under the KYDEX® trademark, etc.) are typically thick, making the concealed carry holsters somewhat cumbersome, which may result in undesirable printing, which may in turn render the concealed carry holster detectable to others and, thus, defeat the purpose of the concealed carry holster—to enable an individual to carry a firearm without others noticing that the individual is carrying the firearm.

Concealed carry holsters with collapsible firearm receptacles reduce the likelihood of printing, but a collapsible firearm receptacle typically collapses under the force of the waistband of an individual's bottoms once a handgun has been removed from the collapsible firearm receptacle. Once the collapsible firearm receptacle has collapsed, it can be difficult to reinsert the handgun, often requiring the individual to simultaneously pull on the waistband of his or her bottoms and user his or her fingers to open the collapsible firearm receptacle.

DISCLOSURE

Figure 1:
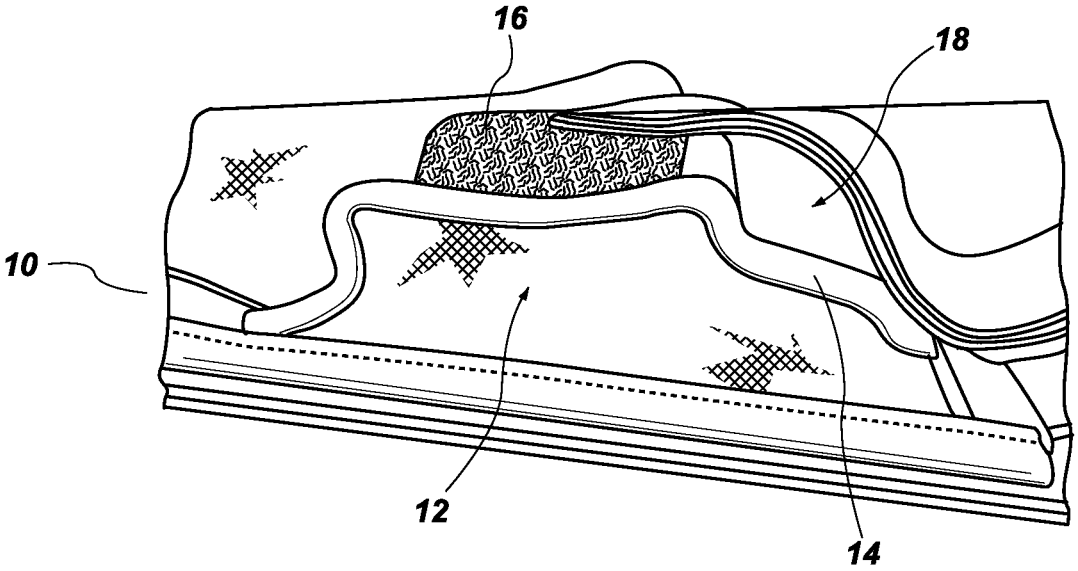
FIG. 1 illustrates an embodiment of a concealed carry holster with a collapsible firearm receptacle, showing an interior of the collapsible firearm receptacle.

FIG. 1 shows an embodiment of a collapsible firearm receptacle 12, or pocket, of a concealed carry holster 10, such as that described by U.S. Design Pat. D761,553, issued on Jul. 19, 2016 and titled CONCEALED CARRY HOLSTER, the entire disclosure of which is hereby incorporated herein. Some collapsible firearm receptacles 12 may be "universal," meaning that they can accept the barrels of a variety of different configurations of firearms (e.g., handguns, etc.). As depicted, a top portion 14 of and outer extent 16 of the collapsible firearm receptacle 12 is at least partially collapsed. The outer extent 16 of the collapsible firearm receptacle 12 would be even further collapsed under an individual's clothes (e.g., a belt, a waistband of the individual's bottoms, etc.).

Turning now to FIGS. 2-8, various views of an embodiment of an insert 20 for the collapsible firearm receptacle 12 of FIG. 1 are provided. The insert 20 has a shape that enables it to fit snugly within the collapsible firearm receptacle 12. A shape of an interior 40 of the insert 20 enables the insert 20 to receive the barrel of a firearm (e.g., a handgun, etc.) and, optionally, at least portions of a trigger and trigger guard of the firearm. The insert 20 may maintain its shape under a variety of conditions (e.g., repeated insertion and drawing of the firearm, the heat of the barrel of a recently used firearm, etc.). The material of the insert 20 and the surfaces 42, 47, 49 that define the interior 40 of the insert 20 may be smooth, minimizing friction against the barrel and other parts of the firearm as it is inserted into and drawn from the interior 40 of the insert 20.

Figure 2:
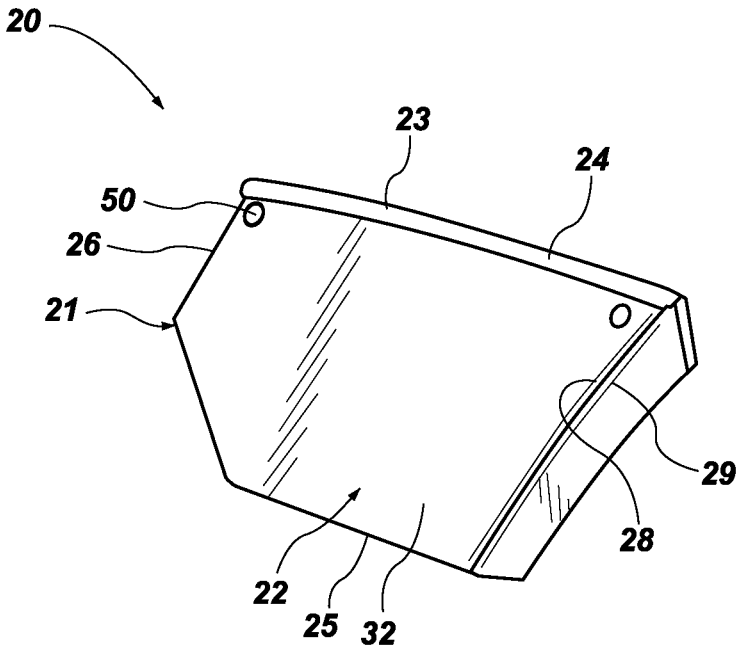
FIG. 2 is a front perspective view an embodiment of an insert for a collapsible firearm receptacle of a concealed carry holster.
Figure 3:
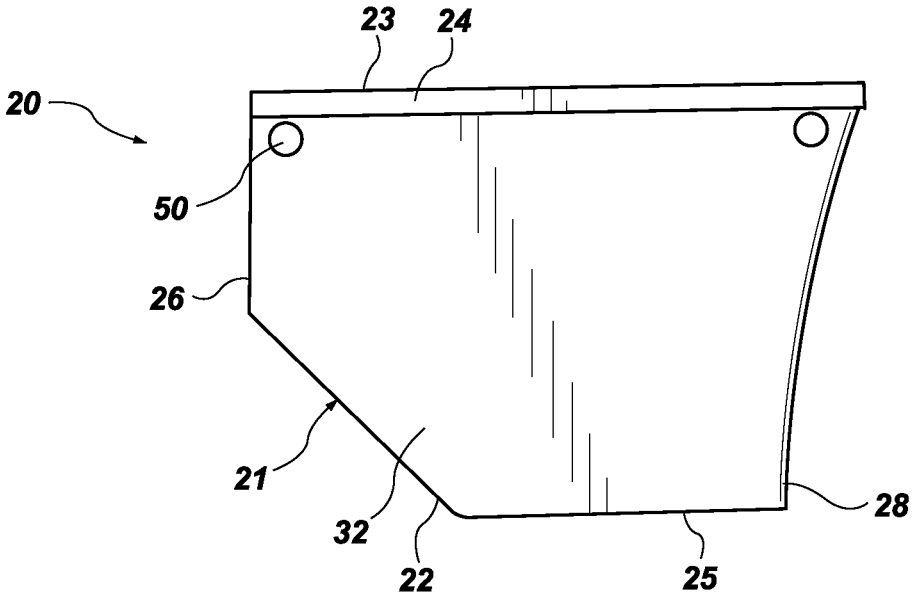
FIG. 3 is a front, or exterior, view of the embodiment of insert shown in FIG. 2.
Figure 5:
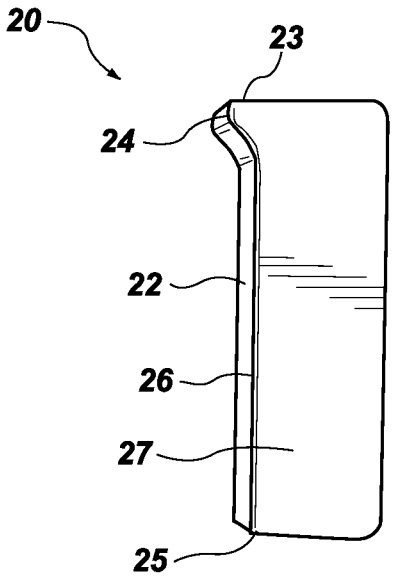
FIG. 5 is a first side view of the embodiment of insert shown in FIG. 2.
Figure 6:
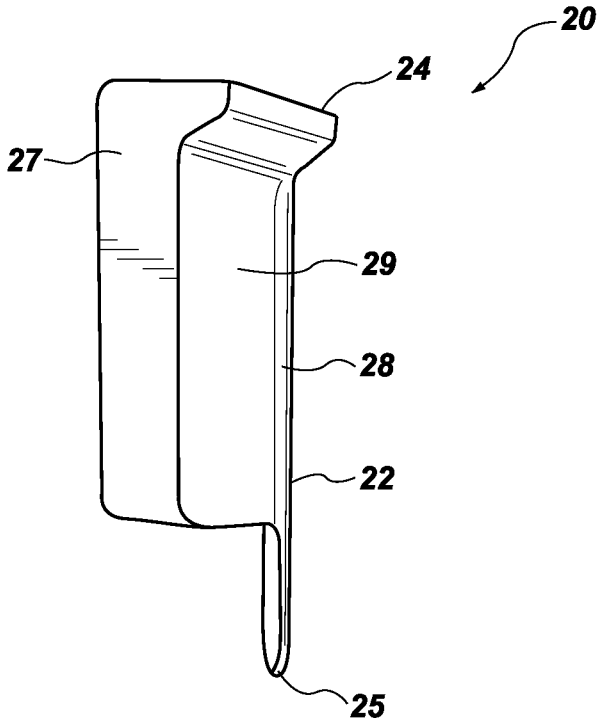
FIG. 6 is a second side view of the embodiment of insert shown in FIG. 2.

The insert 20 may be manufactured from a substantially rigid material. Such a material may be strong, which may enable use of a small amount (e.g., volume, etc.) of the material to provide a lightweight insert 20. The material from which the insert 20 is made may have a low coefficient of friction (e.g., about 1 or less, about 0.75 or less, about 0.5 or less, etc.). As a non-limiting example, an insert according to this disclosure may comprise, consist essentially of, or consist of a carbon fiber reinforced polymer Outer surfaces 31 of the insert 20 are shown in FIGS. 2, 5, and 6. The insert 20 comprises a body 21 that includes an outer wall 22. The outer wall 22 includes an upper edge 23, a bottom edge 25, a front edge 26, a rear edge 28. The body 21 of the insert 20 also includes a front wall 27 that extends from the front edge 26 of the outer wall 22 and a rear wall 29 that extends from the rear edge 28 of the outer wall 22.

The upper edge 23 of at least a portion of the body 21 of the insert 20 (e.g., of the outer wall 22, etc.) may be fluted or include a lip 24. The flute or the lip 24 may protrude outward from the upper edge 23 of the outer wall 22, as well as from an upper edge of the remainder of the body 21 (e.g., upper edges of the front wall 27 and the rear wall 29, etc.). Thus, the flute or the lip 24 may overhang the outer surfaces of the outer wall 22, the front wall 27, and the rear wall 29. The flute or the lip 24 may have a configuration that enables it to prevent over-insertion of the insert 20 into the collapsible firearm receptacle 12 (FIG. 1) of a concealed carry holster 10 (FIG. 1).

The insert 20 may also include one or more engagement features 50 capable of enabling the body 21 to be secured to the collapsible firearm receptacle 12 (FIG. 1) of a concealed carry holster 10 (FIG. 1). The engagement features 50 may include holes, such as those depicted by FIGS. 2-4, which may enable the insert 20 to be coupled to the outer extent 16 (FIG. 1) of the collapsible firearm receptacle 12 (FIG. 1) (e.g., with a coupling element, such as stitching with thread, a rivet, or the like). Other embodiments of engagement features 50 may also be used. The engagement features 50 may be located on the outer wall 22 of the body 21 of the insert 20, as illustrated, on the front wall 27 of the body 21, on the rear wall 29 of the body 21, and/or on the flute or the lip 24, if the insert 20 includes a flute or a lip 24.

The outer wall 22 and the front wall 27 of the insert 20 may have shapes that accommodate features of the collapsible firearm receptacle 12 (FIG. 1) of the concealed carry holster 10 (FIG. 1). As an example, the diagonally oriented portion of the rear edge 28 of the outer wall 22 may accommodate a stop for a trigger guard (not shown) that has been sewn into a rear portion 18 (FIG. 1) of the collapsible firearm receptacle 12 (FIG. 1) (e.g., the diagonally stitched feature shown in the drawings of U.S. Design Pat. D761, 553, etc.)

Figure 4:
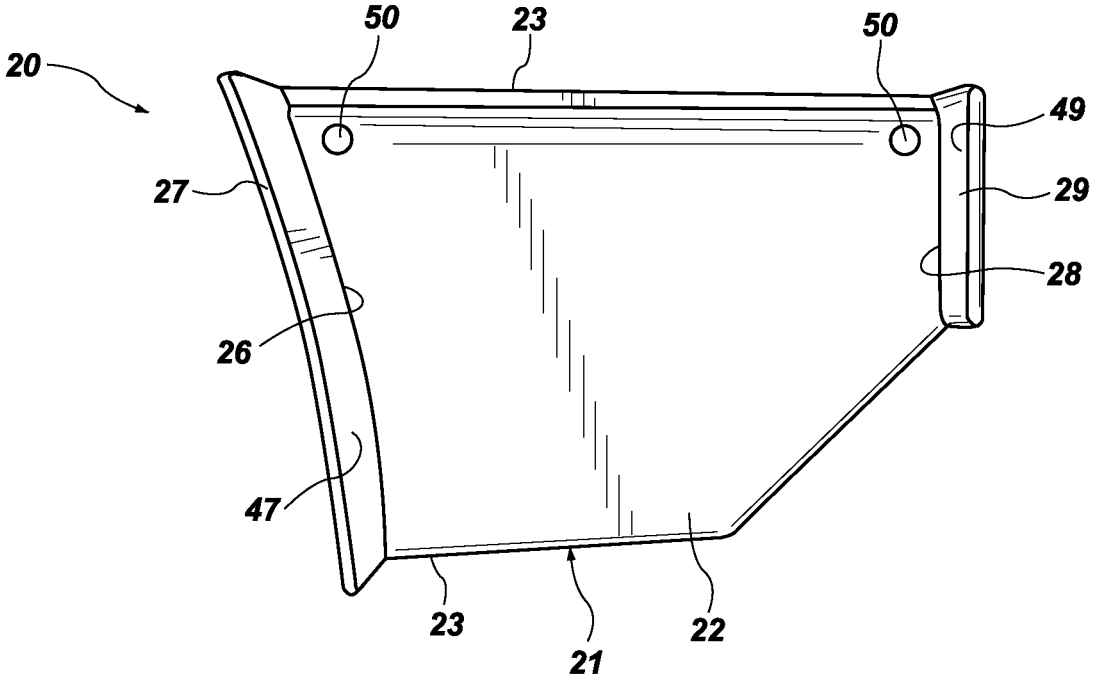
FIG. 4 is a rear, or interior, view of the embodiment of insert shown in FIG. 2.

With reference to FIGS. 4-6, the front wall 27 of the body 21 of the insert 20 extends from the front edge 26 of the outer wall 22. The rear wall 29 extends from the rear edge 28 of the outer wall 22. Both the front wall 27 and the rear 29 wall extend away from the outer surface 32 of the outer wall 22, or in an inward direction, or inwardly, relative to a collapsible firearm receptacle 12 (FIG. 1) within which the insert 20 is configured to be inserted.

As can be seen in FIGS. 5-8, the front wall 27 is longer than the rear wall 29. The length of the rear wall 29 and the diagonally oriented section of the rear edge 28 of the outer wall 22 enable a rear portion of the insert 20 to rest on a stop for a trigger guard within a rear portion 18 (FIG. 1) of the collapsible firearm receptacle 12 (FIG. 1). The distance the front wall 27 extends from the outer wall 29 at least partially defines a width of the insert 20 (e.g., a width of a front extent of the insert 20, etc.).

The distance the rear wall 29 extends from the outer wall 22 at least partially defines a width of the insert 20 (e.g., a width of a rear extent of the insert 20, etc.). Notably, the distance the rear wall 29 extends from the outer wall 22 is shorter than the distance the front wall 27 extends from the outer wall 22.

FIG. 6 also shows the flute or the lip at the top of the outer wall of the insert.

Figure 7:
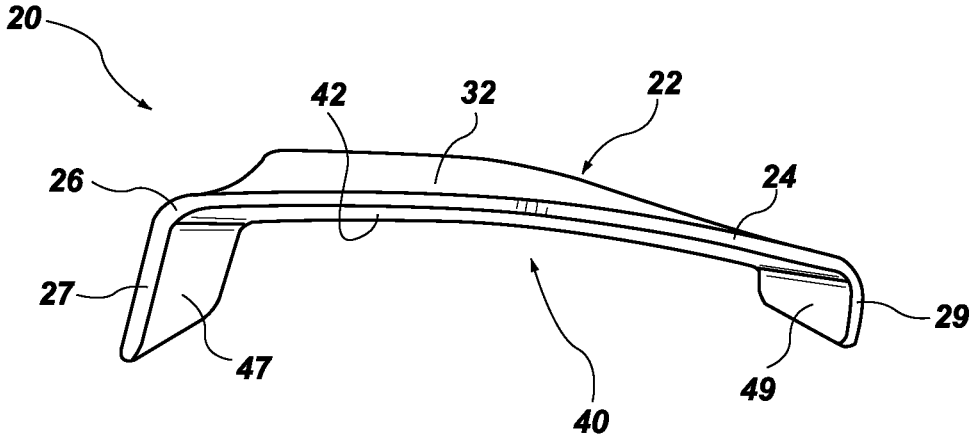
FIG. 7 is a top view of the embodiment of insert shown in FIG. 2.
Figure 8:
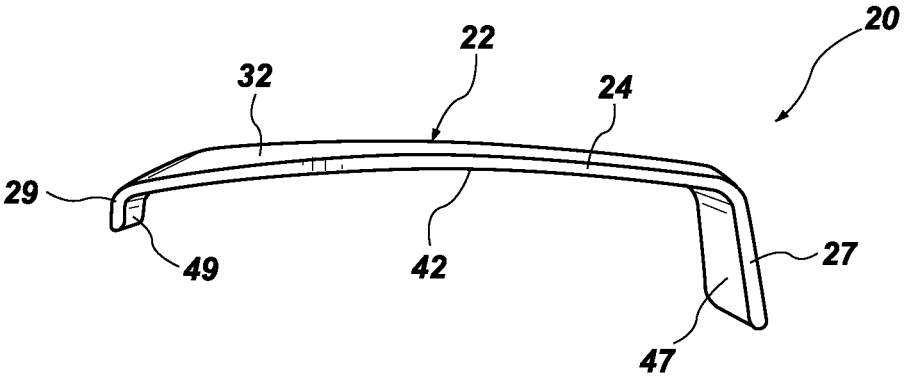
FIG. 8 is a bottom view of the embodiment of insert shown in FIG. 2.

In addition, FIG. 6 shows the convex shape of the outer wall (from its outer surface), which can also be seen in FIG. 7.

Figure 9:
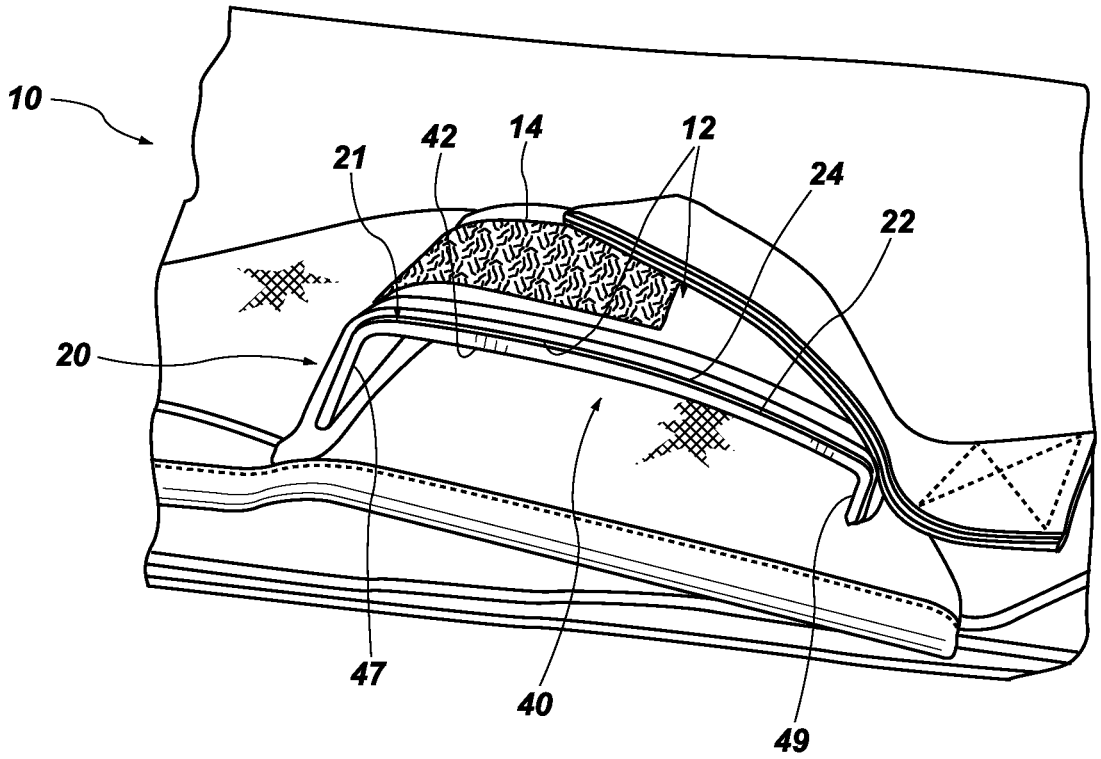
FIG. 9 shows the embodiment of insert shown in FIG. 2 in the collapsible pocket of the embodiment of concealed carry holster shown in FIG. 1.

FIG. 9 shows the insert 20 within at least a top portion of the collapsible firearm receptacle 12 of a concealed carry holster 10. As can be seen in FIG. 9, the insert 20 may have a size that corresponds to a size of at least the top portion of the collapsible firearm receptacle 12. The insert 20 may be configured to fit snugly into at least the top portion of the collapsible firearm receptacle 12, which may impart at least the top portion of the collapsible firearm receptacle 12 with a desired shape.

The interior surfaces 42, 47, 49 that define the interior 40 of the insert 20 may have a lower coefficient of friction than a fabric from which the interior surfaces of the collapsible firearm receptacle 12 are made. Thus, any drag that may be created as a firearm is pulled from the collapsible firearm receptacle 12 may be reduced, enabling removal of the firearm from the concealed carry holster 10 more quickly when the insert 20 is in place within at least the top portion of the collapsible firearm receptacle 12 than when the insert 20 is not in place therein.

By holding at least the top portion of the collapsible firearm receptacle 12 at least partially open before a firearm is introduced therein or after a firearm is removed therefrom, the firearm may be more easily inserted or reinserted into the collapsible firearm receptacle 12. More specifically, an individual may introduce the barrel of the firearm into the collapsible firearm receptacle 12 without having to manipulate its outer extent 14 with the end of the barrel of the firearm or with the individual's hand.

FIG. 9 also depicts the body 21 of the insert 20, including its outer wall 22, as being very thin. The body 21 may have a thickness of about 2 mm or less, about 1.5 mm or less, or even about 1 mm or less. Thus the insert 20 may be used within the collapsible firearm receptacle 12 without significantly increasing the overall width of an assembly that includes the concealed carry holster 10, the insert 20, and a firearm. At most, the insert 20 would increase the thickness of such an assembly by the thickness of the outer wall 22 of the body 21 of the insert 20 and, possibly, the extent to which a flute or a lip 24 of the insert 20 extends beyond an upper edge of the outer extent 14 of the collapsible firearm receptacle 12. In embodiments where a portion of the firearm that remains outside of the collapsible firearm receptacle 22 is wider than each portion of the firearm that resides within the collapsible firearm receptacle 12, and that excess width is greater than the added thickness of the outer wall 22 of the body 21 of the insert 20 and any flute or lip 24 that extends from the upper edge of the outer wall 22, the insert 20 does not affect (i.e., increase) the overall thickness of the assembly. Furthermore, the thickness of the body 21 of the insert 20 may enable the insert 20 to be introduced into the collapsible firearm receptacle 12 while consuming very little (e.g., about 5% or less, about 4% or less, about 3% or less, about 2% or less, about 1% or less, etc.) of the volume of the collapsible firearm receptacle 12 when formed to the same shape as the shape dictated by the insert 20.

The width of the collapsible firearm receptacle 12 may be about 2 cm or less, about 1.5 cm or less, or about 1 cm or less. Such a width may accommodate the barrels of some firearms. In embodiments where the outer extent of a collapsible firearm receptacle 12 is formed from a stretchable material, such a width may also accommodate barrels with widths that exceed the distance across the opening, while still providing an opening of sufficient width to facilitate the insertion of the barrel of the firearm into the collapsible firearm receptacle 12.

Although the preceding description relates to an insert (e.g., a carbon fiber reinforced polymer insert, etc.) configured for use with a collapsible firearm receptacle, or a so-called "universal pocket," insets according to this disclosure may be configured to improve the characteristics (e.g., drag while pulling a firearm, ease with which a firearm is introduced into a holster, etc.) of form fitted and other non-collapsible holsters.

Although this disclosure provides many specifics, the specifics should not be construed as limiting the scope of any appended claim, but merely as providing information pertinent to some specific embodiments that may fall within the scopes of the appended claims. Features from different embodiments may be employed in combination. In addition, the scope of each appended claim may encompass other, undisclosed embodiments. All additions to, deletions from, and modifications of the disclosed subject matter that fall within the scopes of the claims are to be embraced by the claims.

What is claimed:

1. An insert for a concealed carry holster, comprising:

a body comprising a carbon fiber reinforced polymer having a substantially rigid construction and including:

an outer wall with an outer surface, an inner surface, a top edge, a bottom edge, a front edge, and a rear edge;

a front wall extending from the front edge of the outer wall, away from the outer surface of the outer wall;

a rear wall extending from the rear edge of the outer wall, away from the outer surface of the outer wall, the front wall and the rear wall defining a width of the body, the body configured to be positioned adjacent to an outer extent of a collapsible firearm receptacle of the concealed carry holster and having a shape and a rigidity capable of holding an upper portion of the collapsible firearm receptacle of the concealed carry holster in an open arrangement.

2. The insert of claim 1, wherein the outer wall of the insert has a thickness of 2 mm or less.

3. The insert of claim 1, wherein the inner surface of the outer wall of the body has coefficient of friction of 1 or less.

4. The insert of claim 1, wherein the body consists of a carbon fiber reinforced polymer.

5. The insert of claim 1, wherein the body has a size that corresponds to a size of at least the upper portion of the collapsible firearm receptacle of the concealed carry holster.

6. The insert of claim 5, wherein the body is configured to fit snugly into at least the upper portion of the collapsible firearm receptacle of the concealed carry holster and to impart at least the upper portion of the collapsible firearm receptacle of the concealed carry holster with a desired shape.

7. The insert of claim 6, wherein the width of the body is 2 cm or less.

8. The insert of claim 6, wherein the width of the body is about a same size as or less than a width of a barrel of handgun to be received by the collapsible firearm receptacle of the concealed carry holster.

9. The insert of claim 1, wherein the body further includes:

a lip extending from the top edge so as to at least partially overhang the outer surface of the outer wall.

10. The insert of claim 9, wherein the lip is capable of preventing over-insertion of the body into the collapsible firearm receptacle of the concealed carry holster.

11. The insert of claim 1, further including at least one engagement feature capable of enabling the body to be secured to the collapsible firearm receptacle of the concealed carry holster.

12. A concealed carry holster, comprising:

a collapsible firearm receptacle including:

an inner extent configured to be positioned against a body of an individual; and an outer extent comprising a pliable material, a receptacle defined between the inner extent and the outer extent capable of receiving at least a barrel of a handgun; and an insert capable of being positioned within at least an upper portion of the collapsible firearm receptacle, the insert comprising a substantially rigid material and including:

an outer wall positionable against an outer extent of the collapsible firearm receptacle, the outer wall including an outer surface, an inner surface, a top edge, a bottom edge, a front edge, and a rear edge;

a front wall extending from the front edge of the outer wall, away from the outer surface of the outer wall;

a rear wall extending from the rear edge of the outer wall, away from the outer surface of the outer wall, the front wall and the rear wall defining a width of the insert, the insert configured to be positioned adjacent to an outer extent of a collapsible firearm receptacle of the concealed carry holster and having a shape and a rigidity capable of holding an upper portion of the collapsible firearm receptacle of the concealed carry holster in an open arrangement.

13. The concealed carry holster of claim 12, wherein the substantially rigid material of the insert comprises a carbon fiber-reinforced polymer.

14. The concealed carry holster of claim 12, wherein the pliable material of the outer extent of the collapsible firearm receptacle comprises a stretchable fabric.

15. The concealed carry holster of claim 12, wherein the insert is configured to fit snugly into at least the upper portion of the collapsible firearm receptacle of the concealed carry holster and to impart at least the upper portion of the collapsible firearm receptacle of the concealed carry holster with a desired shape.

16. The concealed carry holster of claim 12, wherein the insert further includes: a lip extending from the top edge so as to at least partially overhang the outer surface of the outer wall, a shape of the insert and the lip being capable of preventing over-insertion of the insert into the collapsible firearm receptacle.

17. A method for using a concealed carry holster, comprising:

positioning an insert comprising a substantially rigid material within at least a top portion of a collapsible firearm receptacle of the concealed carry holster, the insert comprising a front wall, an outer wall, and a rear wall holding the top portion of the collapsible firearm receptacle in an open configuration;

inserting at least a barrel of the firearm into the collapsible firearm receptacle with the insert in place within at least the top portion of the collapsible firearm receptacle, the insert providing a reduced coefficient of friction relative to a material from which an outer extent of the collapsible firearm receptacle is made; and removing at least the barrel of the firearm from the collapsible firearm receptacle, the reduced coefficient of friction of the insert facilitating removal of the barrel of the firearm from the collapsible firearm receptacle.

18. The method of claim 17, wherein assembling the insert comprises adding no more than 2 mm of thickness to an assembly including the collapsible firearm receptacle of the concealed carry holster, the insert, and the firearm.

19. The method of claim 17, wherein assembling the insert comprises adding no more than 1 mm of thickness to an assembly including the collapsible firearm receptacle of the concealed carry holster, the insert, and the firearm.

* * * * *